US009404262B1

(12) United States Patent
Smith, Jr.

(10) Patent No.: US 9,404,262 B1
(45) Date of Patent: Aug. 2, 2016

(54) STANDING SEAM METAL PANEL RECOVER FOR SHINGLED ROOFS

(71) Applicant: McElroy Metal Mill, Inc., Bossier City, LA (US)

(72) Inventor: Charles L. Smith, Jr., Houston, TX (US)

( * ) Notice: Subject to any disclaimer, the term of this patent is extended or adjusted under 35 U.S.C. 154(b) by 0 days.

(21) Appl. No.: 14/709,247

(22) Filed: May 11, 2015

(51) Int. Cl.
*E04D 13/17* (2006.01)
*E04D 3/30* (2006.01)
*E04D 3/36* (2006.01)
*E04D 3/362* (2006.01)

(52) U.S. Cl.
CPC *E04D 3/30* (2013.01); *E04D 3/362* (2013.01); *E04D 3/3607* (2013.01); *E04D 3/3608* (2013.01); *E04D 13/174* (2013.01); *E04D 13/178* (2013.01)

(58) Field of Classification Search
CPC ..... E04D 3/30; E04D 3/3608; E04D 13/17; E04D 13/174; E04D 13/178
See application file for complete search history.

(56) References Cited

U.S. PATENT DOCUMENTS 4,089,145 A * 5/1978 DeVries, Jr. ..... E04D 3/365 52/461
4,099,356 A 7/1978 Graham
4,213,282 A 7/1980 Heckelsberg
4,217,741 A 8/1980 Cole
4,420,913 A 12/1983 Long et al.
4,476,658 A 10/1984 Johnstone
4,575,983 A 3/1986 Lott, Jr. et al.
4,608,791 A 9/1986 McClure
4,642,958 A * 2/1987 Pewitt ..... E04D 3/40 454/250
4,649,684 A * 3/1987 Petree ..... E04D 3/366 52/395
5,022,314 A * 6/1991 Waggoner ..... E04D 13/152 454/250
5,134,825 A 8/1992 Berridge
5,259,166 A * 11/1993 Carey, II ..... E03B 3/02 29/507
5,367,848 A 11/1994 McConnohie
5,692,352 A 12/1997 Simpson et al.
5,737,892 A 4/1998 Greenberg
5,737,894 A 4/1998 Simpson et al.
5,911,663 A 6/1999 Eidson
6,301,853 B1 10/2001 Simpson et al.
6,354,045 B1 * 3/2002 Boone ..... E04D 13/174 52/199
6,401,412 B1 * 6/2002 Cooper ..... E04D 3/366 52/198

(Continued)

OTHER PUBLICATIONS

Architectural Building Components, *Metal Over Metal Retrofit* (http://www.archmetalroof.com/metal-over-metal-retrofit.html) (printed Jan. 19, 2015).

(Continued)

*Primary Examiner* — Christine T Cajilig
(74) *Attorney, Agent, or Firm* — Keith B. Willhelm

(57) ABSTRACT

Metal panel standing seam roof recovers installed over an existing shingled roof. The existing shingled roof comprises a plurality of shingles installed in overlapping rows running across the pitch of the existing roof. The rows of shingles have a covered upper edge and an exposed lower edge. The recover system comprises a plurality of panel clips mounted to the existing shingled roof and arranged in linear arrays running along the pitch of the existing roof. The panel clips have a base that extends across and is supported by the lower edges of a first row of shingles and an adjacent second row of shingles. A recover is attached to the panel clips. The recover comprises a plurality of elongated metal panels having upstanding sides defining lateral edges with a trough therebetween. The metal panels are interconnected along adjacent lateral edges by sidelaps formed on the panel clips.

26 Claims, 8 Drawing Sheets

(56) References Cited

U.S. PATENT DOCUMENTS

| | | | | |
|---|---|---|---|---|
| 6,415,559 | B1 * | 7/2002 | Reeves | E04D 13/00 52/302.3 |
| 6,796,097 | B2 * | 9/2004 | Fensel | E04C 2/20 52/465 |
| 6,883,290 | B2 | 4/2005 | Dinwoodie | |
| 7,861,480 | B2 | 1/2011 | Wendelburg et al. | |
| 8,061,087 | B2 | 11/2011 | Ray | |
| 8,112,945 | B2 * | 2/2012 | Austin | E04D 13/004 52/95 |
| 8,122,667 | B2 | 2/2012 | Ferge et al. | |
| 8,327,590 | B2 | 12/2012 | Ray | |
| 8,341,917 | B2 * | 1/2013 | Resso | E04D 3/366 52/173.3 |
| 8,677,718 | B2 | 3/2014 | Marshall | |
| 8,713,864 | B1 * | 5/2014 | Smith, Jr. | E04D 3/28 52/200 |
| 8,887,464 | B1 | 11/2014 | Smith, Jr. | |
| 8,938,927 | B1 | 1/2015 | Bragg | |
| 2001/0052207 | A1 * | 12/2001 | Davis | E04D 13/174 52/199 |
| 2004/0144040 | A1 * | 7/2004 | Fulford | E04D 13/174 52/57 |
| 2005/0055903 | A1 | 3/2005 | Greenberg | |
| 2005/0086890 | A1 | 4/2005 | Verkamp | |
| 2009/0126303 | A1 | 5/2009 | Ferge et al. | |
| 2010/0275525 | A1 | 11/2010 | Wendelburg et al. | |
| 2011/0016803 | A1 | 1/2011 | Ray | |
| 2011/0099924 | A1 * | 5/2011 | Huang | E04D 13/174 52/198 |
| 2011/0308178 | A1 * | 12/2011 | Daddio | E04D 13/174 52/198 |
| 2012/0233949 | A1 * | 9/2012 | Brannon | E04D 3/3602 52/410 |
| 2014/0202093 | A1 * | 7/2014 | Knighton | E04D 13/174 52/198 |

OTHER PUBLICATIONS

Ask Todd Miller *Metal Roofing Expert, *Exposed Fastener Metal Roofing: Is it Standing Seam?* http://www.asktoddmiller.com/history/exposed-fastener-metal-roofing-is-it-standing-seam/ (Apr. 6, 2013).

Atas Int'l, Inc., *Cool Metal Roofing* (http:/www.atas.com/sustainable/cool-metal-roofing) (printed Mar. 7, 2015).

Cool Metal Roofing Coalition, *Cool Metal Roofing* (Pub. No. FLAGSHIP03 Apr. 2007).

Cool Roof Canada, *Radiant Ventilated Cool Roofing: Metal 'ASV' Batten Ventilation System for Stone Coated Steel Roofing* (http://www.coolroofcanada.com/cool-roof-batten.html) (printed Mar. 7, 2015).

D. Chasar, *Metal Roof Retrofit on a Hurricane Damaged Home* (Copyright 2014 Florida Solar Energy Center) (http://www.ba-pirc.org/CASESTUD/hdh_roof/index.htm).

D. Mckinnis, *Just What is a Standing Seam Metal Roof?* http://www.mckinnisroofing.com/residential-roofmg/just-what-is-a-standing-seam-metal-roof (Aug. 3, 2011).

Englert®, *Englert® sets the standard for innovative, efficient and environmental solutions* (No. 90300A-13) (downloaded Jan. 2015).

Houston Cool Metal Roofs, *The Texas Smart Roof™ : The Coolest Roof in Texas* (http://www.houstoncoolmetalroofs.com/cool-roof-information/cool-roof-design-texas/) (printed Mar. 6, 2015).

J. Bogdan, *Cool Metal Roofs*, Metal Construction News (Feb. 1, 2008) (http://www.metalconstructionnews.com/articles/products/metal-roofing/cool-metal-roofs-the-key-to-sustaining-your-business.aspx).

J. Kosney et al., *Sustainable Retrofit of Residential Roof Using Metal Roofing Panels, Thin-Film Photovoltaic Laminates and PCM Heat Sink Technology*, Journal of Building Enclosure Design pp. 11-13, 35 (Winter 2011).

M. Hastings, *Above Sheathing Ventilation*, Cool Metal Roofing Coalition (Oct. 5, 2009).

MBCI, *MBCI Products—Classic ® Series*, (http://www.mbci.com/classic.html) (printed Apr. 10, 2014).

MBCI, *Metal Roof and Wall Systems Architectural Pricing* (Copyright 2013).

McElroy Metal, Inc., *MasterLok Product Information*, (Rev. Apr. 2012).

Schulte Building Systems, Inc., *Serious Performance Through Superior Design—Introducing a New Age of Standing Seam Metal Roofing Above and Beyond the Rest—TD-324 Technology* (© 2008).

Streamline Roofing and Construction Inc., *Facts About Metal Roofing* (http://www.streamlineroofing.com/facts_about_metal_roofs.html) (printed Jan. 20, 2015).

Tri County Metals, *Can You Install Metal Roofing Over Shingles?* (http://tricountymetals.com/can-you-install-metal-roofing-over-shingles/) (printed Jan. 20, 2015).

W. Miller et al., *Above-Sheathing Ventilation for Metal Roofs*, Cool Metal Roofing Forum pp. 15-18 (downloaded Mar. 2015).

W. Miller et al., *Another Benefit from Above-Sheathing Ventilation*, Cool Metal Roofing Forum pp. 19-20 (downloaded Mar. 2015).

W. Miller et al., *The Impact of Above-Sheathing Ventilation on the Thermal and Moisture Performance of Steep-Slope Residential Roofs and Attics*, Proceedings of the Fifteenth Symposium on Improving Building Sysems in Hot and Humid Climates, Orlando, Florida, Jul. 24-26, 2006.

wiseGEEK, *What is Standing Seam Roofing?* (http://www.wisegeek.com/what-is-standing-seam-roofing.htm) (printed Apr. 24, 2014).

* cited by examiner

STANDING SEAM METAL PANEL RECOVER FOR SHINGLED ROOFS

FIELD OF THE INVENTION

The present invention relates to metal panel roof covers and, more particularly, to metal panel roof covers for installation over an existing shingled roof.

BACKGROUND OF THE INVENTION

Shingled roofs utilize individual, overlapping units of prepared roofing materials referred to as shingles. Roofing shingles most commonly are made out of asphalt or wood, such as cut or split cedar and redwood. They also may be fabricated from stone, fiber cement, metal, and plastic. Shingled roofs utilize various flashing and other components where the fields of a roof terminate or intersect, such as the eaves, gables, valleys, ridges, and hips of a roof. Even in roofs having many different intersecting or overlapping fields, however, the basic construction of shingled roofs across the major expanse of a roof is fairly standard.

Most commonly, the roof substructure includes rafters. The rafters typically are dimensional wood boards which run vertically, i.e., along the pitch of the roof from the eaves to the ridges. Sheathing is installed on the rafters to provide a deck. The deck provides the structural support for the roof cover. The sheathing typically is plywood, oriented, strand board (OSB), or wooden planks. Spaced boards also may be used to provide a deck.

An underlayment, usually consisting of asphalt-saturated felt (tar paper), is generally installed to protect the deck. Other barrier webs may be installed both above and below the deck, such as reflective barriers or moisture barriers. Ice and water barriers often will be installed along the eaves and valleys of the roof.

The shingles provide the cover for the roof. For example, so-called strip or 3-tab asphalt shingles are in widespread use. They are have a somewhat elongated, rectangular shape. A pair of cutouts run partially across the shingle from its lower or butt edge to define the three tabs. The shingles may incorporate a factory-applied strip or spots of heat sensitive adhesive on their upper, lap portions. A starter strip also typically will be installed along the eaves to cover portions of the deck that otherwise would be exposed by the cutouts in the shingles.

The shingles are installed on the deck in overlapping rows or "courses" that run horizontally, i.e., across the pitch of the roof. The shingles are installed with their longer ends parallel to the eave. The first course is installed along the eave of the roof, typically over a starter strip. Successive courses are then laid up the slope of the roof. Typically, the shingles are installed without overlaps as they run along a course, but may be provided with Dutch laps at their ends. If the shingles are not self-sealing, adhesive may be applied to the upper, lap portion of the shingles as successive courses are installed. Overlapping courses of shingles will be more resistant to uplift in heavy wind if they are adhered to underlying course.

Overlapping courses are installed such that the butt edge of the course overlaps slightly more than half the width of the lower, underlying course of shingles. It will be appreciated that this installation pattern creates a head lap. That is, the pattern provides area of triple coverage: areas where the upper edge, mid portion, and butt edge of three courses overlap.

Roofs in general are designed to endure. Three-tab asphalt shingle roofs, for example, on average last 15 to 18 years.

Eventually, however, they will deteriorate to the point where the cover is no longer weather proof. Removing and replacing the shingles has a number of advantages, especially where the roof is in serious disrepair. Stripping the old shingles will expose the roof deck and allow repair of any deteriorated underlayment and sheathing. Removing the old shingles also minimizes the load on the roof substructure.

On the other hand, removing an existing roof can be expensive and can disrupt occupants of a building. It also creates large quantities of waste that must be disposed of, and eliminates not only the existing roof, but whatever insulation value the existing roof may have provided. It also is quicker and cheaper to simply install new shingles over the existing shingles.

For example, new courses may be nested into existing courses by butting the top edge of the new shingles against the butt edge of the old shingles. Tapered wood filler strips or "feathering" strips also may be used, especially with thicker shingles. The feathering strips will be placed along the butt edge of the old shingles to create a level surface for installing new shingles. Recovering existing shingles with new shingles, however, greatly increase the load on the roof substructure.

Metal panel covers also have been used to "recover" deteriorated shingle roofs. A new metal cover, or "recover" over an existing cover will add much less weight to the roof as compared to simply installing new shingles over the old. Metal panel recovers also offer significantly longer service life—up to 40 years or more. That extended service life, however, often comes with a much greater cost. Metal panel recovers can be at a significant disadvantage relative to cheaper alternatives such as simply re-shingling the roof.

Metal panel covers, whether a new installation or a recover, utilize rather elongated metal panels installed along the slope of a roof. Each cover panel is typically about a foot to three feet in width. Though they may be cut to any length, they commonly are 30 to 40 feet long and may run as long as 200 feet. The lateral edges of the panels are bent in various configurations to form upwardly extending sides and a trough in the middle. The trough is where most of the water will be shed from the roof.

Adjacent panels are joined along their upwardly extending sides to create relatively narrow seams which are elevated above the trough. The panels are laid out such that the seams run vertically, i.e., with the slope of the roof. The panels also may have one or more ridges running vertically through the trough, and it is those vertically oriented seams and ridges that create the distinctive appearance that consumers associate with metal roofs. More importantly, however, since the seams between adjacent panels are formed a few inches above the troughs where most rain will be shed, metal panel roofs can be very resistant to leaking.

Raised-seam, metal panels may be classified according to the manner in which they are installed. So called "through panel" or "exposed" fastener panels are installed with screws or other fasteners that penetrate through the cover panels. The panels typically are laid over a roof so that their sides overlap and form a raised, often trapezoidal shaped seam or "lap" rib. The panels then are joined together along the lap rib by, e.g., gasketed screws. Gasketed screws also are driven through the trough. When used to recover a shingled roof, the through-panel fasters will be driven in the shingles and sheathing. Leakage around the fastener, at least initially, is not a significant problem. Over time, however, the elastomeric material from which the screw gaskets are fabricated can deteriorate, and leaks tend to develop around penetrating fasteners.

"Standing seam" covers can provide better resistance to leakage over longer periods of time and, in the eyes of many beholders, provide a more beautiful roof. In a standing seam cover, the metal panels are secured with concealed clips instead of unsightly and leak-prone penetrating fasteners. Most commonly, a plurality of relatively small panel clips are installed in a fairly widely spaced, array running vertically (along the slope of the roof) in what will become a seam line between adjacent panels. Panels are then installed between the vertical lines of clips, with the upturned seam edges of the panels abutting and mating with the clips and each other. There are no penetrations through the panels when clips are used. Moreover, all gaps between the panels and the clips are elevated well above the trough through which most water runoff occurs. Thus, standing seam panel covers provide better, longer resistance to leakage as compared to covers using screws or other "through panel" fasteners that penetrate the panels.

There are many conventional systems that use non-penetrating clips with standing seam metal panels for new installations. In new installations, the clips typically are mounted to an array of spaced, elongated support members or "purlins" which are mounted across the structural rafters of a roof substructure. The purlins run horizontally across the rafters, i.e., across the slope of the roof.

Such systems are disclosed in U.S. Pat. No. 4,575,983 to H. Lott, Jr. et al. Panel clips are mounted on purlins, and the metal panels secured to the clips. The panels disclosed therein are asymmetrical standing seam panels. Asymmetrical panels have mating male-female connections, each panel having a male connection formed in one side and a female connection formed in its other side. Thus, installation must proceed in a certain direction across the roof, and removal for repair must proceed in the opposite direction.

Symmetrical standing seam panels, however, have sides which are identical and are joined with a separate seam cover. Symmetrical panels, therefore, may be installed in either direction. A damaged panel also may be removed for replacement without removing any adjacent panels. Examples of new installation, symmetrical standing seam roof covers where non-penetrating individual clips are mounted on purlins are disclosed in U.S. Pat. No. 4,649,684 to L. Petree et al. Other covers, such as those disclosed in U.S. Pat. No. 6,354,045 to M Boone et al. and U.S. Pat. No. 5,737,892 to P. Greenberg, utilize individual and elongated, "continuous" clips that are mounted to and span adjacent purlins. While they are more costly than covers using asymmetrical panels, such symmetrical panel covers can offer improved leak protection, better uplift resistance, and longer service life.

U.S. Pat. No. 8,887,464 to C. Smith and U.S. Pat. No. 8,938,924 to C. Smith disclose standing seam metal panel recovers for installation over existing metal panel roofs. Those systems include systems where the panels are installed using a combination of individual and continuous clips. The individual clips are arranged in linear arrays, each individual clip being mounted on a single purlin. Thus, the base of the clip has a very limited span, typically only a few inches, just long enough to run across the width of the purlin with some play. The continuous clips are extremely elongated—up to 30 feet long—with each continuous clip spanning at least two, or more typically, many purlins.

The upper surface of a shingled roof, however, is by its nature quite uneven. It is unsuited for use with individual clips such as those disclosed in the '464 and '924 patents. Moreover, extremely long continuous clips are difficult to work with during installation. Thus, when metal panels have been used to recover deteriorated shingled roofs, various supporting structures have been provided to provide a more even surface upon which the metal panels may be installed.

For example, a new underlayment may be laid over the existing shingles and new, exposed fastener metal panels installed over the underlayment. Alternately, wood boards or "battens" may be nailed into the existing deck and running horizontally across the existing shingles. Exposed fastener panels then may be installed on the battens. See Tri County Metals, *Can You Install Metal Roofing Over Shingles?* (http://tricountymetals.com/can-you-install-metal-roofing-over-shingles/); and D. Chasar, *Metal Roof Retrofit on a Hurricane Damaged Home* (Copyright 2014 Florida Solar Energy Center) (http://www.ba-pirc.org/CASESTUD/hdh_roof/index.htm).

Alternatively, wood batten and counter-batten systems have been used to provide a supporting structure upon which metal panels may be installed. Such systems are disclosed, for example, in Houston Cool Metal Roofs, *The Texas Smart Roof™: The Coolest Roof in Texas* (http://www.houstoncoolmetalroofs.com/cool-roof-information/cool-roof-design-texas/). Similar metal batten-counter-batten systems have been devised for installation of metal tiles and shingles. Cool Roof Canada, *Radiant Ventilated Cool Roofing: Metal 'ASV' Batten Ventilation System for Stone Coated Steel Roofing* (http://www.coolroofcanada.com/cool-roof-batten.html).

Such systems employ horizontally oriented battens and vertically oriented "cross-battens." That crisscrossing pattern not only elevates the recover well above the existing shingles, it allows for above sheathing ventilation (ASV). That is, convective air currents caused by the heating of the roof have a path allowing flow of heated air from the eave toward the ridge.

Above sheathing ventilation can dramatically reduce the amount of heat transmitted through the roof into a structure. It will be appreciated, however, that convective flow paths created by batten-counter-batten systems are somewhat tortuous. In addition, and while metal systems are lighter weight than wood and are said to be less expensive, batten-counter-batten systems typically will add both cost and weight to a recover system.

The statements in this section are intended to provide background information related to the invention disclosed and claimed herein. Such information may or may not constitute prior art. It will be appreciated from the foregoing, however, that there remains a need for new and improved systems, apparatus and methods for installing metal panels over existing shingled roofs. Such disadvantages and others inherent in the prior art are addressed by various aspects and embodiments of the subject invention.

SUMMARY OF THE INVENTION

The subject invention, in its various aspects and embodiments, is directed generally to metal panel standing seam roof "recovers" that are installed over an existing shingled roof. One aspect of the invention provides for a metal panel standing seam roof recover system installed over an existing shingled roof having a pitch. The existing shingled roof comprises a support frame that includes an array of elongated roof support members extending along the pitch of the existing roof. A deck is installed on the roof support members, and a cover is installed on the deck. The cover comprises a plurality of shingles installed in overlapping rows running across the pitch of the existing roof. The rows of shingles have a covered upper edge and an exposed lower edge.

The metal panel standing seam roof recover system comprises a plurality of panel clips mounted to the existing roof and arranged in linear arrays running along the pitch of the existing roof. The panel clips have a base that extends across and is supported by the lower edges of a first row of shingles and an adjacent second row of shingles. A recover is attached to the panel clips. The recover comprises a plurality of elongated metal panels having upstanding sides defining lateral edges with a trough therebetween. The metal panels are interconnected along adjacent lateral edges by seams formed on the panel clips.

Other aspects provide such recovers where the panel clips support the metal panels above the cover such that clearance is provided between the top side of the cover and the bottom side of the recover. Another aspect provides such recovers where the clearance is sufficient to allow convection air flow between the top side of the cover and the bottom side of the recover.

Preferred embodiments also include recovers where the panel clips are installed by a fastener extending through the shingles and into the deck. Other embodiments provide recovers where the panel clips are installed by a fastener extending through the shingles proximate to the lower edges thereof and into the deck.

Yet other aspects and embodiments provide such recovers where the shingles are asphalt shingles or other types of shingles, where the shingles have an exposure of from between about 4 to about 6 inches or between about 4 to about 8 inches, or where the length of said base of said clips is about 8 inches or from about 6 to about 18 inches.

Further embodiments provide such recovers where the base of the panel clips extends across and is supported by two lower edges of shingle courses, or by three lower edges, or by four lower edges.

Still other embodiments provide recovers where the panel clips comprise a vertical body and a horizontal bottom flange. The bottom flange provides the base of the panel clips and the panel clips are installed by a clip fastener extending through the bottom flange, through the shingles proximate to lower edges thereof and into the sheathing.

Various aspects and embodiments will utilize recovers where the metal panels are symmetrical or asymmetrical panels.

Yet other aspects and embodiments provide recovers that comprise an eave assembly. The eave assembly comprises a vent strip extending along an eave of the recover between the bottom side of the recover and the top side of the cover. The eave vent strip has openings therein which are adapted to allow convection air flow into the clearance between the cover and recover. Preferably, the eave vent strip is formed from perforated sheet metal.

Further embodiments and aspects provide recover systems where the eave vent strip has a first portion which is installed on the top side of the cover, a second, intermediate portion in which are provided the openings, and a third portion which is installed on the bottom side of the recover.

In still other aspects, the invention is directed to metal panel standing seam roof recover systems installed over an existing shingled roof which comprises a ridge assembly. The ridge assembly comprises a vent strip extending along a ridge of the recover. The ridge vent strip has openings and is mounted such that the openings are spaced above the troughs of the metal panels. The ridge assembly also includes a ridge cap mounted on the ridge vent strip. The ridge cap extends over and above the openings in the ridge vent strip whereby convection air flow from the clearance between the cover and recover may flow under the ridge cap and out the openings in the ridge cap.

In another aspect the invention provides such recovers where the ridge assembly comprises a trough closure extending vertically between the seams of the metal panels, and wherein the ridge vent strip is mounted on the closure.

Other preferred embodiments include such recovers where the ridge assembly comprises a panel support extending along the ridge. The panel support is attached to the cover and has corrugations supporting the metal panels. The corrugations run along the pitch of the roof thereby allowing convection air flow through the panel support.

Yet another aspect and embodiment provides such recovers where the ridge assembly comprises a trough closure which is fastened to the corrugated panel support.

The subject invention also includes methods for installing a metal panel standing seam recover over an existing shingled roof. The existing shingled roof comprises a support frame that includes an array of elongated roof support members extending along the pitch of the existing roof. A deck is installed on the roof support members, and a cover is installed on the deck. The cover comprises a plurality of shingles installed in overlapping rows running across the pitch of the existing roof. The rows of shingles have a covered upper edge and an exposed lower edge.

The method comprises installing an array of panel clips on the existing roof. The panel clips are installed such that they extend across and are supported by the lower, exposed edge of a first row of shingles and by the lower, exposed edge of an adjacent second row of shingles. Elongated metal panels then are attached to the clips by forming seams on the panel clips.

Other aspects provide such methods where the panel clips support the metal panels above the cover such that clearance is provided between the top side of the cover and the bottom side of the recover. Another aspect provides such recovers where the clearance is sufficient to allow convection air flow between the top side of the cover and the bottom side of the recover.

Preferred embodiments also include methods where the panel clips are installed by a fastener extending through the shingles and into the deck. Other embodiments provide methods where the panel clips are installed by a fastener extending through the shingles proximate to the lower edges thereof and into the deck.

Yet other aspects and embodiments provide such methods where the shingles are asphalt shingles or other types of shingles, where the shingles have an exposure of from between about 4 to about 6 inches or between about 4 to about 8 inches, or where the length of said base of said clips is about 8 inches or from about 6 to about 18 inches.

Further embodiments provide such methods where the panel clips extend across and are supported by two lower edges of shingle courses, or by three lower edges, or by four lower edges.

Still other embodiments provide methods where the panel clips comprise a bottom flange, a vertical body, and a horizontal bottom flange. The bottom flange provides a base of the panel clips and the panel clips are installed by a clip fastener extending through the bottom flange, through the shingles proximate to tower edges thereof and into the sheathing.

Various aspects and embodiments of the methods will utilize metal panels which are symmetrical or asymmetrical panels.

Yet other aspects and embodiments provide methods which includes installing an eave assembly which includes a vent strip. The eave vent strip is installed along an eave of the recover between the bottom side of the recover and the top side of the cover. The eave vent strip has openings therein which are adapted to allow convection air flow into the clearance between the cover and recover. Preferably, the eave vent strip is formed from perforated sheet metal.

Further embodiments and aspects provide methods where the eave vent strip has a first portion which is installed on the top side of the cover, a second, intermediate portion in which are provided the openings, and a third portion which is installed on the bottom side of the recover.

In still other aspects, the invention is directed to methods of installing metal panel standing seam roof recover systems over an existing shingled roof which also includes installing a ridge assembly. A vent strip is installed along a ridge of the recover. The ridge vent strip has openings and is mounted such that the openings are spaced above the troughs of the metal panels. A ridge cap is installed on the ridge vent strip. The ridge cap extends over and above the openings in the ridge vent strip whereby convection air flow from the clearance between the cover and recover may flow under the ridge cap and out the openings in the ridge cap.

In another aspect the invention provides such methods where installation of the ridge assembly includes installation of a trough closure extending vertically between the seams of the metal panels. The ridge vent strip is mounted on the closure.

Other preferred embodiments include such methods where installation of the ridge assembly includes installation of a panel support extending along the ridge. The panel support is attached to the cover and has corrugations supporting the metal panels. The corrugations run along the pitch of the roof thereby allowing convection air flow through the panel support.

Yet another aspect and embodiment provides such methods where a trough closure is fastened to the corrugated panel support.

Finally, still other aspect and embodiments of the invention will have various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1:
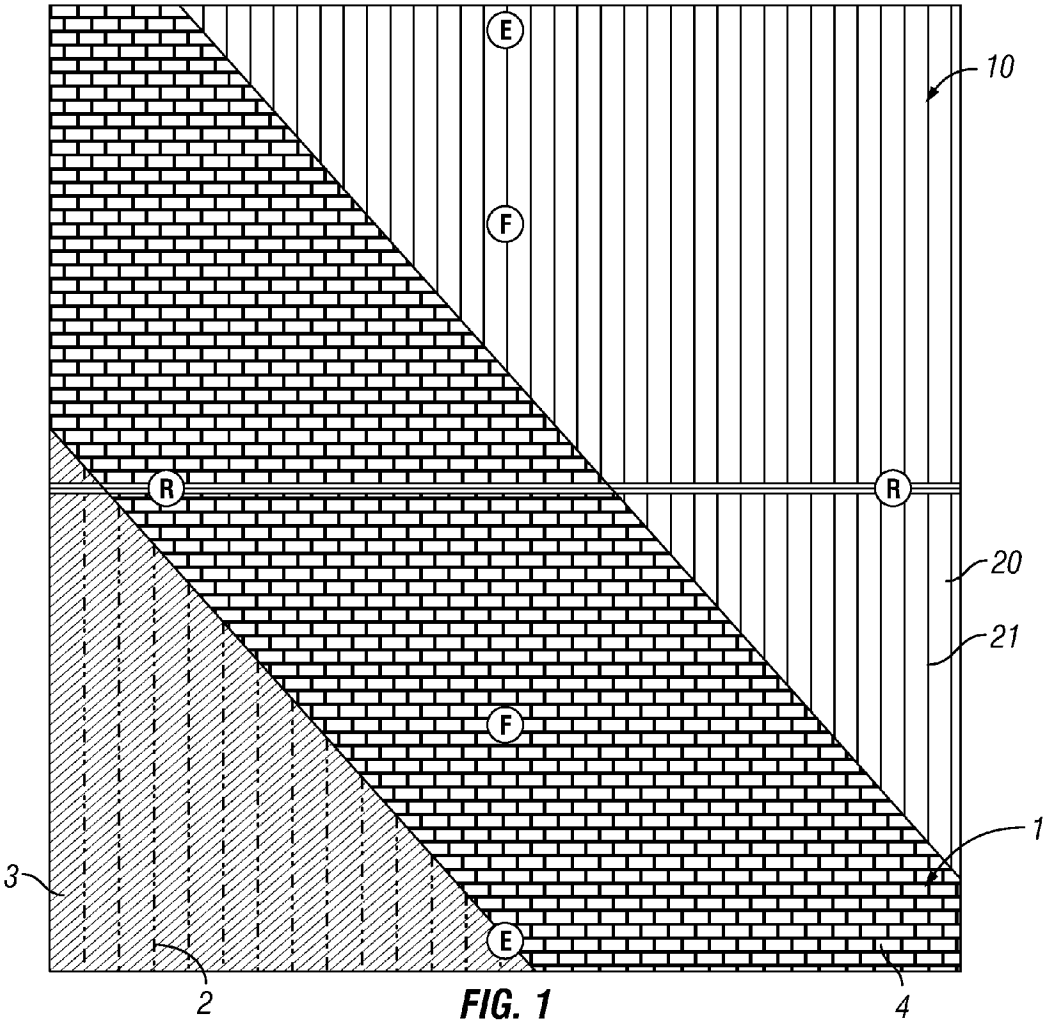
FIG. 1 is a plan view, including partial tear-away views, of a conventional shingled roof 1 which has been recovered with a first preferred embodiment 10 of the metal panel roof recovers of the subject invention.

In the drawings and in the description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The present invention generally relates to metal panel roof covers for installation over an existing roof, that is, to metal panel roof "recovers." The novel metal panel roof recovers may be installed over many types of conventional shingled roofs, such a gabled, hip, mansard, and gambrel roofs, or roofs incorporating several basic designs. For example, novel metal panel recover 10 is installed over prior art shingled roof 1 as shown in FIGS. 1-7.

Existing shingled roof 1 is a typical gabled roof, that is, it has two roof fields F that slope upwards from their eaves E and intersect at a ridge R. The roof support frame (not shown in large part) typically will provide each field F in roof 1 with a pitch of at least 2:12 (2 inches of vertical rise for every 12 inches of horizontal reach). A shingled cover usually is designed to be hydrokinetic. That is, they are designed to shed water, and a minimum pitch must be maintained to ensure water flow off the roof.

The roof support frame includes an array of spaced support members or "rafters" 2. Rafters 2 typically are made from relatively large dimensional wood boards, such as 2×10s or 2×12s, but they also may be metal. As will be appreciated from FIG. 1, rafters 2 run "vertically" through the roof. That is, they run along the pitch of fields F of roof 1, as opposed to running "horizontally" or across the pitch.

Sheathing is installed on rafters 2 to provide a deck 3. A shingled cover, by itself, is incapable of supporting any significant load. Thus, deck 3 provides a support for and a surface onto which shingles 4 may be installed. Deck 3 as illustrated in FIGS. 1-7 is made from plywood or OSB sheets and provides a more or less continuous support surface. Many conventional shingled roofs, however, have spaced dimensional boards, such as 1×4s or 1×6s, which run horizontally across the fields of the roof. In other roofs, shingles may be installed on sheet metal decks Shingles 4 are conventional 3-tab asphalt shingles having rectangular tabs of uniform size and exposure. It will be appreciated, however, that the novel recover systems may be installed over covers utilizing other types of shingles. They may be installed, for example, over covers having no-cutout shingles, which lack tabs, or random-tab shingles, which have tabs of varying sizes and exposure. They also may be used with covers having shingles made from other materials, such a cut or split wood. As will be appreciated from the description that follows, some modifications may be necessary depending on the type of shingles present in an existing roof, but such modifications are well within the skill of the art.

Figure 5:
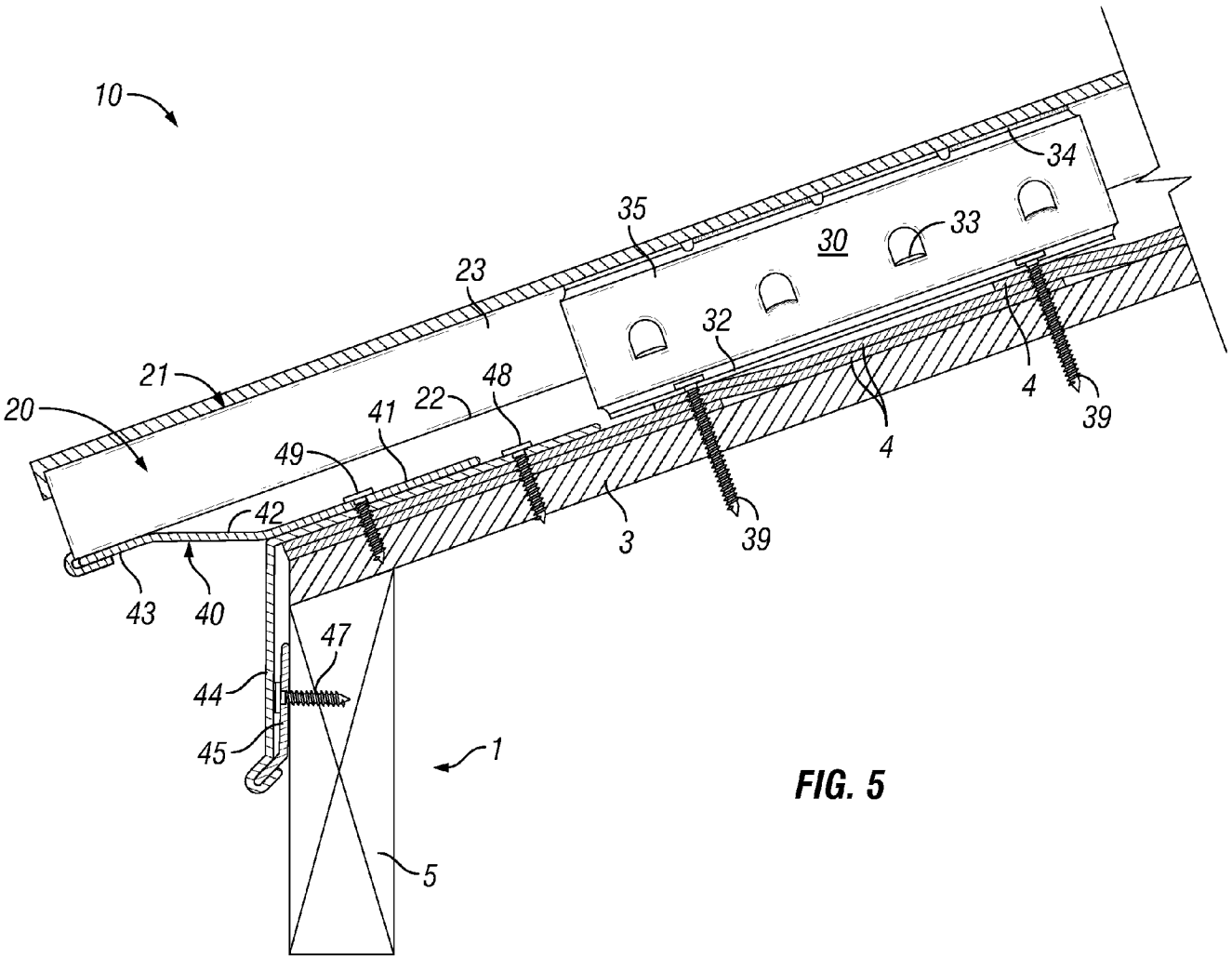
FIG. 5 is a cross-sectional view, taken generally along a lap ridge 21 in the eave area of novel roof recover 10 shown in FIGS. 1-4.
Figure 7:
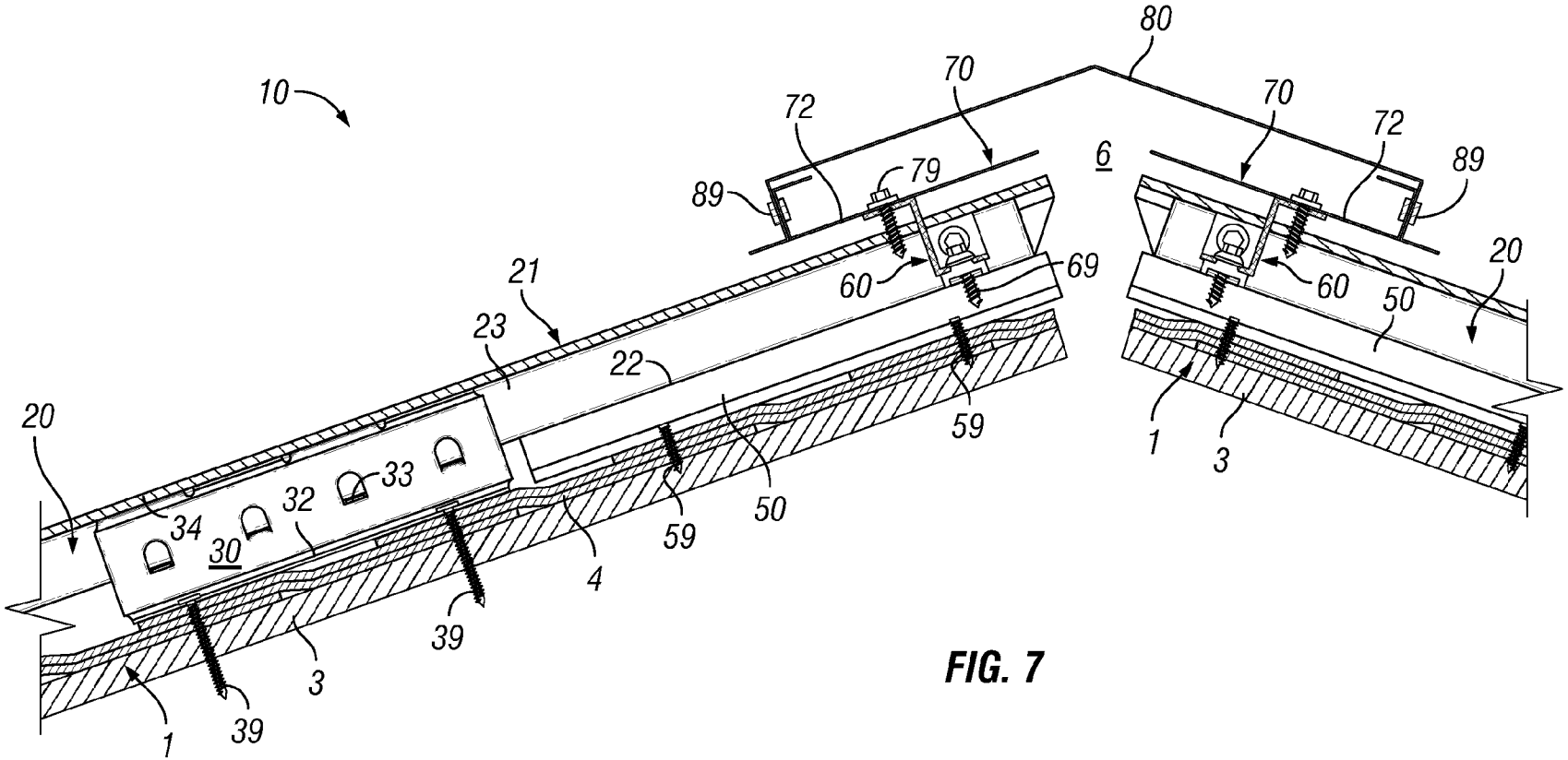
FIG. 7 is a cross-sectional view, taken generally along a lap ridge 21 in the ridge area of novel roof recover 10 shown in FIGS. 1-6.

Shingles 4 are installed in overlapping courses running horizontally across fields F of roof 1. Starting at eaves E, each course of shingles partially overlaps the course below it. In particular, each course of shingles commonly will be installed such that its butt edge overlaps slightly more than half the width of the lower course of shingles. Thus, an area of triple coverage is created where the upper edge, mid portion, and butt edge of three courses overlap. That overlap is best seen in FIGS. 5 and 7, although it will be appreciated that as in all the accompanying figures that the components illustrated therein are not necessarily to scale. In particular, the proportions and arrangement of shingles 4 in FIGS. 5 and 7, are intended to exaggerate somewhat the overlap areas for the sake of better illustrating the preferred embodiments.

The novel roof recover systems, however, may be installed over shingled roofs with other installation patterns. It also will be appreciated that shingled roofs incorporate other components which for the sake of clarity have been omitted from the drawings. Roof 1, since it incorporates asphalt shingles 4, almost certainly will be provided with an underlayment of tar paper to protect the underside of shingles 4 from the deteriorating effects of repeated thermal expansion. Ice and water barriers commonly will be incorporated as well, as may be reflective barriers or other types of barriers.

The novel metal panel roof recovers will be described in relation to existing shingled roof 1. It is to be understood, however, that the novel roof recovers may be installed over other types of existing shingled roofs without departing from the principles of the present invention.

Various preferred embodiments of the novel metal panel standing seam roof recovers will generally comprise a plurality of panel clips mounted to the existing roof and a plurality of elongated metal panels which are interconnected on the panel clips. The panel clips are arranged in linear arrays running along the pitch of the existing shingled roof. The panel clips have a base that extends across and is supported by the lower edge of a row of shingles and the lower edge of an adjacent row of shingles. A recover is attached to the panel clips. The recover comprises a plurality of elongated metal panels having upstanding sides defining lateral edges with a trough therebetween. The metal panels are interconnected along adjacent lateral edges by seams formed on the panel clips.

For example, preferred novel roof recover 10 generally comprises roof recover metal panels 20 and panel clips 30. As best appreciated from FIGS. 1, 2, and 6, metal panels 20 run vertically and are interconnected along their lateral edges by standing seams 21. Standing seams 21 define troughs 22 through which water is shed from recover 10. The upper ends of metal panels 20 extend under a ridge cap 80 installed along ridge R of recover 10. Preferably, each metal panel 20 runs down the entire slope of recover 10 to its eave E, but the troughs may be provided by two or more panels overlapped at their ends. It also will be appreciated that the panels may terminate in a hip ridge or in a valley depending on the design of the existing roof, such as where there are intersecting gabled roofs. Shingled roofs may have many different or intersecting fields, and the novel roof recovers may be adapted accordingly.

The panels used in the novel recover metal roofs are the same type of standing seam panels as are conventionally used in metal panel roof covers. Thus, they may be fabricated from materials and by methods as are commonly employed in the art. Typically, such panels are fabricated from roll stock of painted or unpainted coated steel, such as Galvalume™ steel, zinc, copper, or aluminum. The roll stock is fed into a roll former which shapes the metal sheet into the desired configuration and cuts it to a desired length. Preformed panels may be used for a particular installation and cut as necessary, or a former may mounted on a trailer or truck so that panels may be fabricated on a job site.

It also will be appreciated that the novel metal panel roof recovers will be exemplified as using symmetrical metal panels of a particular configuration. Other types of symmetrical panels may be used, however, as may be asymmetrical metal panels. A variety of conventional symmetrical and asymmetrical panels are known and may be adapted for use in the subject invention. For example, 138T and 238T symmetrical metal panels sold by McElroy Metal may be used. Asymmetrical, "mechanically seamed," and "snap-in" standing seam metal panels also may be used. Panels of this type are available commercially from a number of manufacturers, such as the Maxima and Medallionlock standing seam panels sold by McElroy Metal.

Panel clips are used to secure recover metal panels to an existing shingled roof and to facilitate the formation of standing seams between the metal panels. Panel clips 30, for example, are used to secure metal panels 20 over existing shingled roof 1 and to facilitate the formation of seams 21 between laterally adjacent panels 20 as seen best in FIGS. 2-4. As described in further detail below, panel clips 30 are installed in linear arrays. The arrays of panel clips 30 run vertically through field F of existing roof 1 along what will become the seam lines for metal panels 20. Thus, the linear arrays of clips 30 are separated horizontally by a distance substantially equal to the width of metal panels 20.

Figure 8:
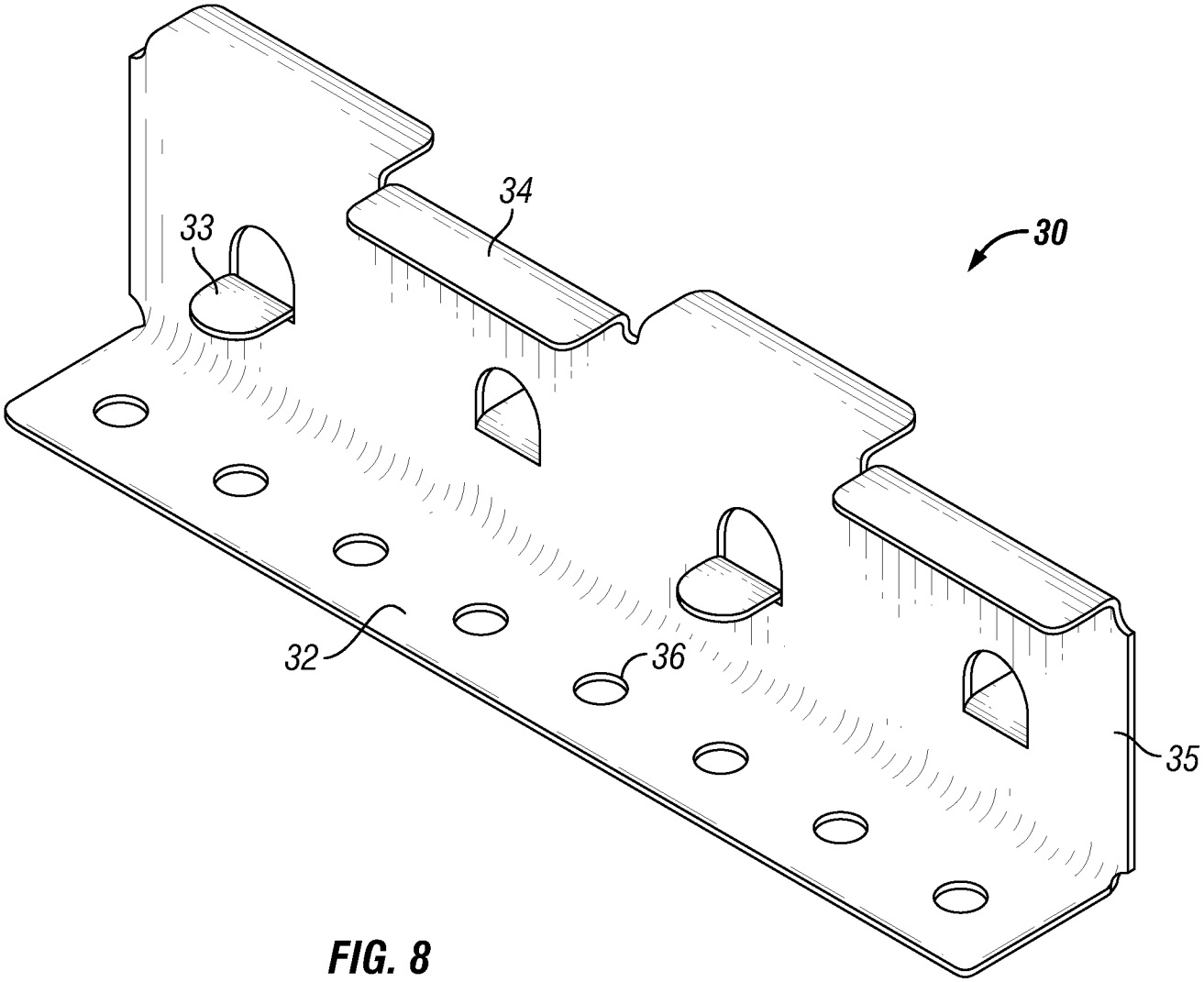
FIG. 8 is a perspective view of a preferred embodiment 30 of panel clips of the subject invention, panel clip 30 being used in novel roof recover 10 shown in FIGS. 1-7.

More particularly, as seen best in FIG. 8, panel clips 30 include a bottom flange 32, shelf flanges 33, and top flanges 34 that extend generally horizontally from a vertically oriented web or body 35. In accordance with the invention, and as best appreciated from FIGS. 2, 5, and 7, it will be appreciated that the length of bottom flange 32 is sufficient to enable panel clips 30 to span the butt edges of adjacent courses of shingles 4. Thus, panel clips 30 will be supported substantially only on the butt edges such that the horizontally extending shelf flanges 33 and top flanges 34 in the array of clips 30 will be substantially parallel to each other and to the slope of existing roof 1.

A typical 3-tab asphalt shingle, for example, has an exposed area of from about 5 to about 5.5 inches, and more comprehensively, will have an exposed area of from about 4 to about 6 inches or from about four to eight inches. Thus, clips having a base of about 8 inches will be preferred and adequate for most asphalt shingle installations. In most installations, clips of that length will span at least two butt edges and, therefore, will allow more precise alignment with the slope of the existing roof as described above. They also may be spaced along the pitch so as to effectively support and connect the metal panels, and they generally will provide savings in material costs and easier installation as compared to longer clips.

The base of the panel clips will span at least two butt edges, and thus for some installations shorter clips may be used. Somewhat longer clips also may be provided which span more than two butt edges, but preferably the clips will span no more than four butt edges. Thus, clips having a base of from about 6 to about 18 inches are preferred. It will be appreciated that optimum or preferred lengths may differ depending on the particular shingle present in the existing roof.

In contrast, conventional individual panel clips used in other metal panel systems are too short to span the butt edges of conventional shingled roofs. The base of such clips has a very limited span, typically only a few inches, given that it is just long enough to run across the width of relatively narrow purlins. On the other hand, extremely long, continuous clips which are used in recover installations over other types of roofs, require considerably more material and may be somewhat cumbersome to install and work with on a job site.

Panel clips 30 are attached to existing roof 1 by fasteners, such as a pair of screws 39, extending through bottom flange 32 of clips 30 and shingles 4 into deck 3 of existing roof 1. Preferably, as exemplified, panel clips 30 are placed on existing roof 1 such that each of screws 39 extend into the overlap area of shingles 4 just slightly above the butt edges, that is, the head lap areas of adjacent courses.

It will be appreciated, however, that a greater or lesser number of screws 39 or other fasteners may be used to mount panel clips 30 to existing roof 1. Typically at least two fasteners will be used to resist torque about the connections and to provide greater stability for clips 30. Where wind uplift is of minimal concern, however, it may be possible to mount panel clips 30 with a single fastener. Conversely, additional screws 39 or other fasteners may be installed through base 32 when more stability and strength is required in the connection between panel clips 30 and existing roof 1.

Preformed round apertures 36 preferably are provided in base 32 of panel dips 30 to accommodate screws or other fasteners. If desired, however, slots may be provided, or screws may be driven through base 32. The exact length of dips 30 and base 32 thereof, as well as the placement, configuration, and number of apertures 36, preferably are coordinated to allow for some imprecision in placement of clips 30 during installation.

Shelf flanges 33 of panel clips 30, along with top flanges 34, provides support for metal panels 20. Top flanges 34 also facilitate the formation of standing seams 21 between metal panels 20. That is, as best appreciated from the cross-sectional views of FIGS. 3-4, the lateral edges of panels 20 are bent upwards to provide upwardly extending sides 23 on both sides of trough 22. The upper portion of panel sides 23 is doubled over horizontally to form a narrow u-shaped channel 24 running vertically on top of each side 23 of panels 20. It will be noted that metal panels 20 are symmetrical, that is, their sides 23 are mirror images.

As metal panels 20 are installed, therefore, sides 23 of panels 20 will be supported on the top surfaces of shelf flanges 33 in adjacent lines of clips 30. At the same time, u-shaped channels 24 in the upper portion of sides 23 of panels 20 are slipped over top flanges 34 of clips 30. A seam cover 25 then is provided over and around the exterior of channels 24 to secure panels 20 to each other and to clips 30. Preferably, a sealant, such as a bead of silicone caulk or elastomeric tape, is provided between seam cover 25 and the exterior of channels 24 to enhance the weather tightness of seams 21. A seamer also may, and preferably is used to securely connect and seal seam cover 25 to panel sides 23.

While panel clips 30 are used in preferred embodiments of the novel roof recovers, the invention is not limited thereto. Other clip configurations may be used if desired. For example, panel clips 30 in novel roof recover 10 are a unitary component, but panel clips suitable for use in other embodiments of the subject invention may be assembled from multiple pieces. For example, the various flanges in the exemplified clip 30 are integral with the clip body. If desired, however, various flanges may be provided as separate components affixed to a clip body, e.g., by welding.

The exact dimensions of shelf flanges and top flanges in the novel panel clips also are not especially critical and may be varied somewhat to provide as much or as little support surface as may be desired or necessary for a particular installation. Likewise, clips 30 have four shelf flanges 33 and four top flanges 34, two flanges 33 and 34 extending in each direction. Other clips, however, may be provided with an number of shelf flanges and top flanges extending in opposite directions.

The clips used in the novel metal panel roof recovers preferably are made from steel, such as 16 to 24 gauge galvanized steel sheets that may be easily formed and bent and cut into a desired configuration by conventional metal forming equipment. Such materials provide a rugged, weather resistant clip that may be manufactured easily and economically. Other metals, such as extruded aluminum, may be used to fabricate the panel clips, however, as well as rigid, moldable or extrudable plastics.

It also will be appreciated that the configuration of the panel clips will be coordinated with the choice of panels used in the novel recover systems. Though similar in many respects, clips for other symmetrical or asymmetrical metal panels may have somewhat different configurations as are suitable for the panel. It is believed that a wide variety of panel clips for a variety of metal panels may be adapted for use in the subject invention.

Preferred embodiments of the panel clips will provide clearance between the existing roof and the recover. For example, as best appreciated from the cross-sectional views of FIGS. 3-5 and 7, when panel clips 30 are installed on existing roof 1 shelf flanges 33 are situated somewhat above the surface of existing roof 1. Thus, when metal panels 20 are attached to panel clips 30, a clearance or space 11 is created between shingles 4 of existing roof 1 and the bottom side of metal panels 20.

Preferably, the clearance provided between an existing roof and the recover is sufficient to allow convection air flow in space created thereby or, what is referred to in the industry as above sheathing ventilation (ASV). For example, as air in space 11 is heated to temperatures above the ambient temperature, it will rise and recover 10 will tend to direct it up the slope of existing roof 1 toward ridge R. Movement of hot air up the slope will allow cooler ambient air to enter space 11 from the eave E, as described in further detail below. Given the fluid properties of hot air, sonic movement up the slope will occur if there are any flow paths available, and any movement of hot air from space 11 to a cooler ambient will remove a certain amount of heat from the roof system. Preferably, however, clearance 11 between existing roof 1 and recover 10 is sufficiently large to allow significant flow of air through space 11 when existing roof 1 and recover 10 are heated significantly above ambient temperature. By establishing convection air flow through space 11, large quantities of heat may be removed from the roof system instead of being transferred into the structure. That, in turn, may significantly reduce the cost of cooling the structure during warm weather.

Thus, clips 30 are configured to provide a clearance 11 of approximately 0.75" between existing roof 1 and recover 10. A clearance of 0.75" is expected to allow convective air flow through the clearance in most installations. Preferably, a clearance of from about 0.5 to about 2 inches is created. Lesser clearances may provide some benefits, but may not be sufficient to allow movement of substantial quantities of air. Higher clearances may provide greater airflow, but may not provide meaningfully greater benefits and may comprise the aesthetics of a structure. Regardless, however, workers in the art will be able to adapt embodiments of the invention to provide desired levels of ASV for particular installations.

Figure 2:
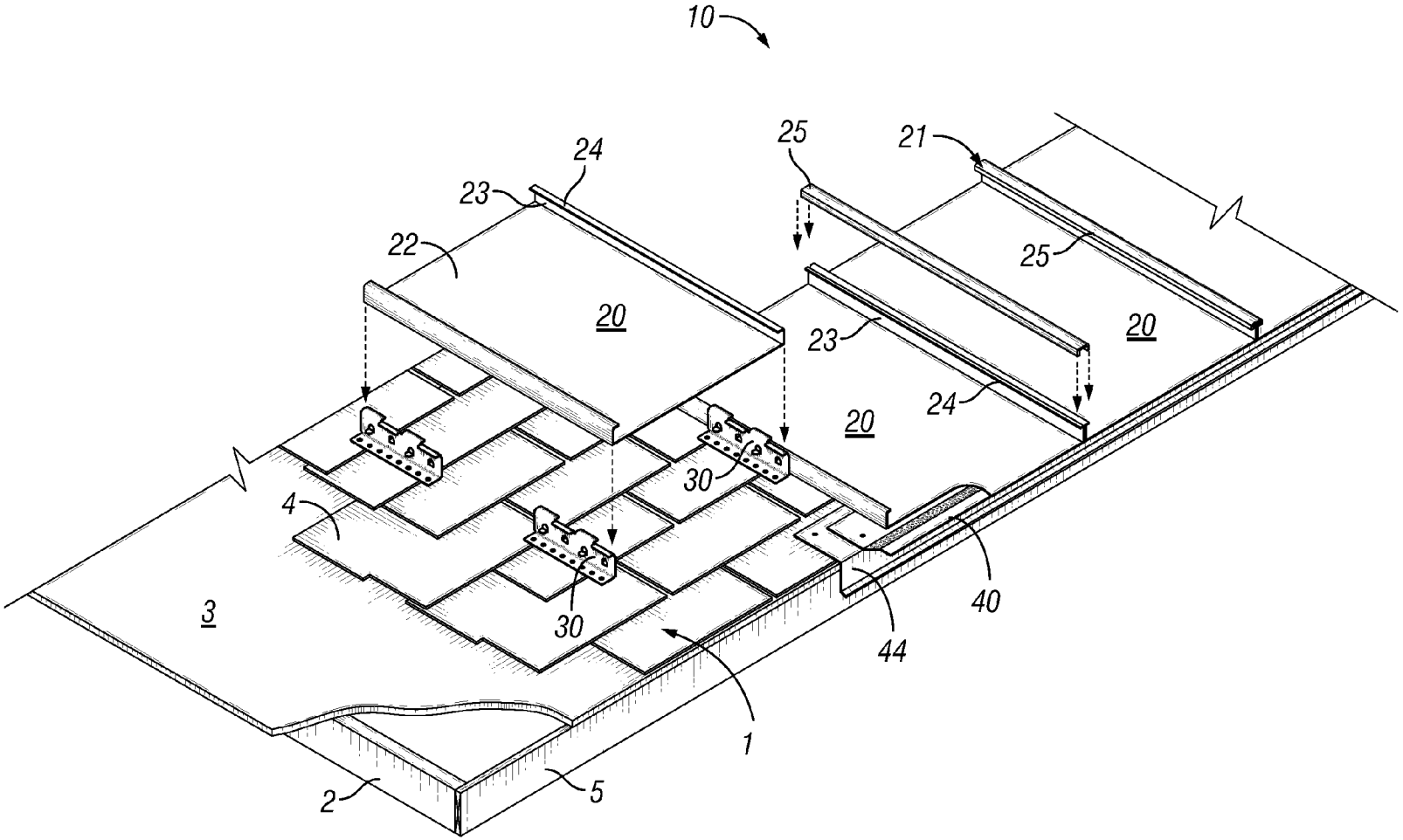
FIG. 2 is a perspective, partially exploded, partial tear-away view of a portion of novel roof recover 10 which has been installed along an eave E of conventional shingled roof 1 (certain components of novel roof recover 10 and conventional roof 1 having been omitted or truncated to better show underlying components)
Figure 3:
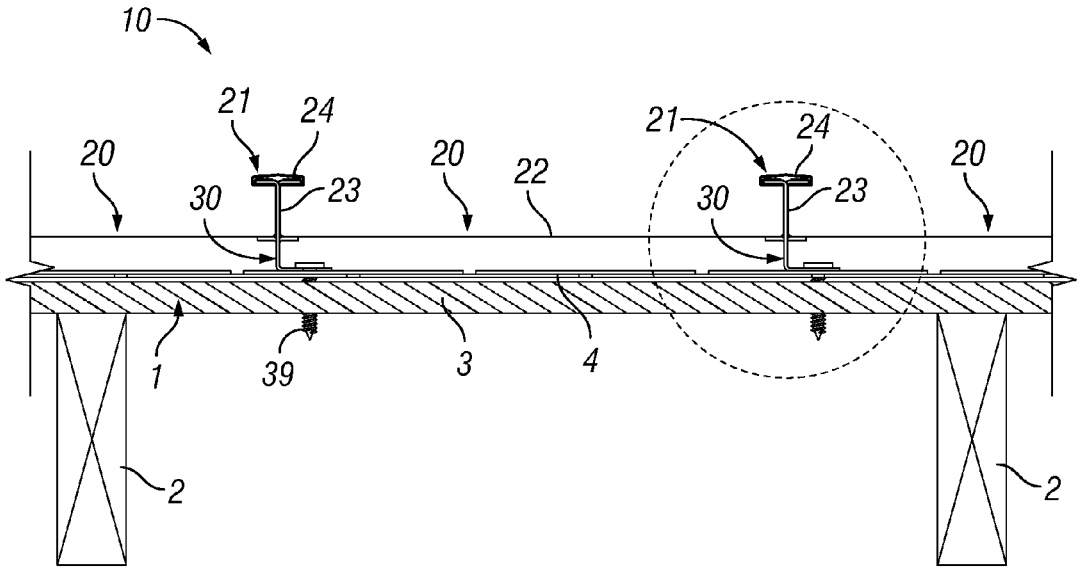
FIG. 3 is a cross-sectional view, taken generally across lap ridges 21 of novel roof recover 10 shown in FIGS. 1-2.
Figure 4:
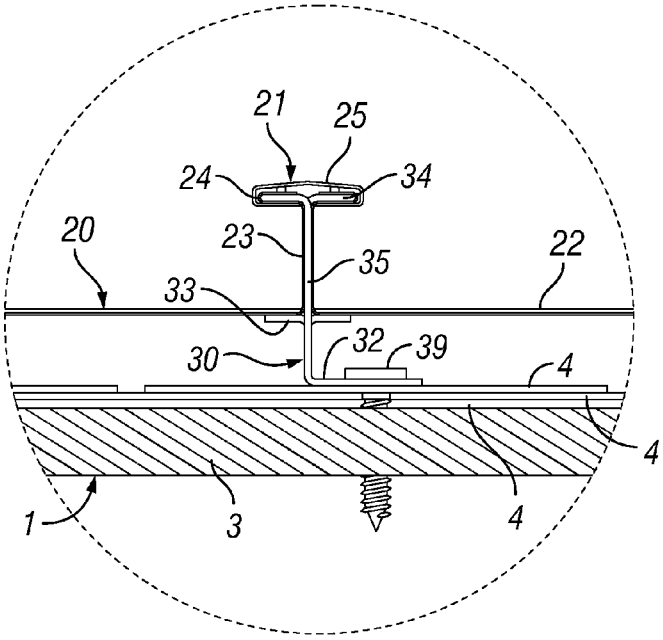
FIG. 4 is an enlarged, detailed view of portion 4 of the view shown in FIG. 3.
Figure 9:
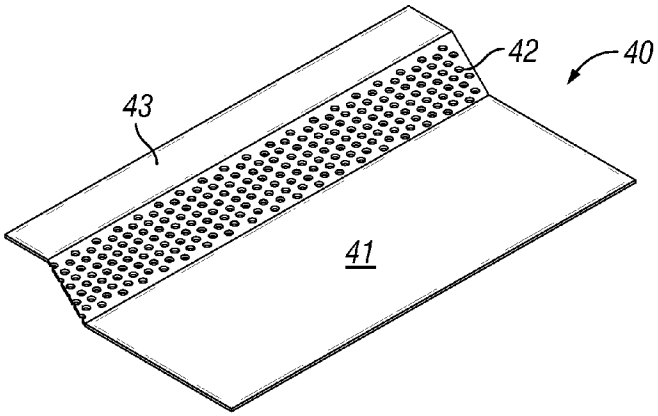
FIG. 9 is a perspective view of a preferred embodiment 40 of eave vent strips of the subject invention (showing the upper side thereof), eave vent strip 40 being used in novel roof recover 10 shown in FIGS. 1-7.

With that in mind, it will be appreciated that the novel recover systems also comprise embodiments providing eave and ridge assemblies that allow air flow and, especially, convective air flow into and out of the clearance between the existing roof and the recover. For example, as seen in FIGS. 2 and 5, recover 10 comprises eave vent strip 40. Eave vent strip 40, as seen best in FIG. 9, includes a generally flat body portion 41. A vent portion 42 angles up and out from body 41, and a lip portion 42 extends from vent portion 42 in a plane generally parallel to the plane of body portion 41. Vent 42 is provided with a plurality of openings. Although not readily apparent from FIG. 9, eave vent strip 40 preferably is rather elongated to facilitate installation and typically will be provided in lengths of from about 10 to about 20 feet which may be overlapped or cut to length as required.

As seen in FIGS. 2 and 5, typically, as in preferred recover 10, an eave trim 44 is first installed on existing shingles 4 along eave E of existing roof 1. Eave trim 44 may be mounted on existing roof 1 by fasteners, e.g., screws 48 extending through eave trim 44, shingles 4, and into deck 3. A portion of eave trim 44 is folded over and, when installed, runs down along the face of existing fascia board 5. The lower portion of eave trim may be secured, for example, by trim cleats 45. Trim cleats 45 are installed on existing fascia board 5 by fasteners, e.g., screws 47. Eave trim 44 provides a neater, cleaner finish for the recover installation and, since the overhanging portions of shingles 4 in existing roof 1 typically will be trimmed to allow installation of recover 10, impedes the flow of water under shingles 4.

Eave vent strip 40 then is installed on eave trim 44 and along eave E of existing roof 1 such its vent portion 42 and lip 43 extend out over existing eave E. Eave vent strip 40 may be mounted on existing roof 1 by fasteners, e.g., screws 49 extending through eave vent strip 40, eave trim 44, shingles 4, and into deck 3. As may be seen in FIG. 5, the ends of metal panels 20, once panels 20 are installed, may be bent around and under lip 43 of eave vent strip 40. In any event, clearance 11 between existing, roof 1 and recover 10 thus is substantially closed along eaves E, but holes in vent portion 42 of eave vent strip 40 will allow air flow into clearance 11. The size, number, and pattern of openings in vent portion 42 may be varied widely. Preferably, that is coordinated with the other features of the recover such that the openings allow convective air flow through the clearance between the existing roof and the recover.

Figure 6:
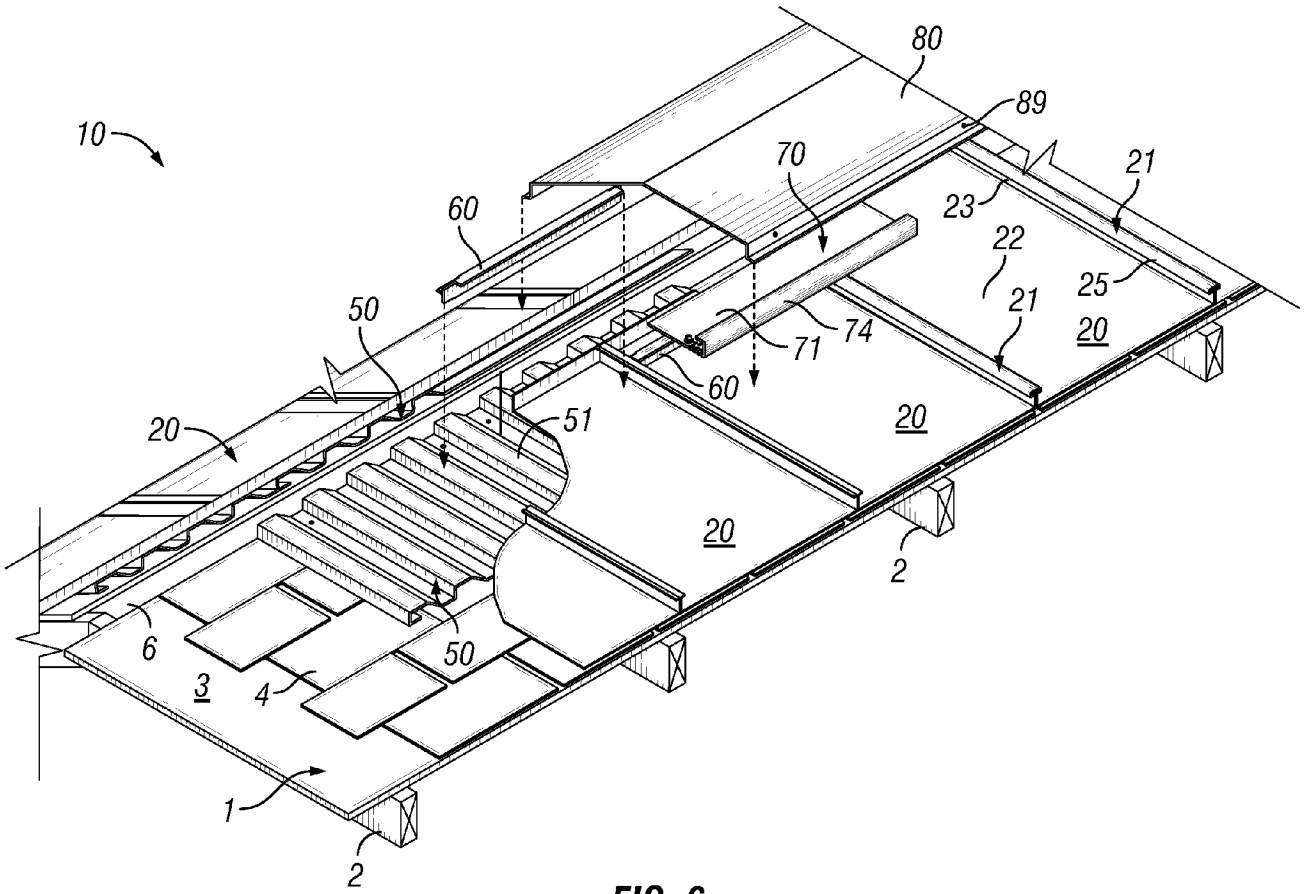
FIG. 6 is a perspective, partially exploded, partial tear-away view of a portion of novel roof recover 10 which has been installed along a ridge R of conventional shingled roof 1 (certain components of novel roof recover 10 and conventional roof 1 having been omitted or truncated to better show underlying components)

Preferred embodiments of the novel roof recover systems also comprises a ridge assembly that facilitates air flow and, especially, convective air flow out of the clearance between the existing roof and the recover. For example, as seen in FIGS. 6 and 7, recover 10 has a ridge assembly that generally comprises a panel support 50, a trough closure 60, a ridge vent strip 70, and ridge cap 80. Initially, it will be noted that fields F of existing roof 1 extend toward, but stop short of intersecting at ridge R. Thus, there is an elongated opening 6 running along ridge R between the upper edges of fields F. If not present in existing roof 1 as originally installed, deck 3 and shingles 4 of existing roof 1 may be trimmed to create opening 6 if desired. The ridge assembly also may be installed on existing roof 1 without providing an opening 6. As will be appreciated from the description that follows, elongated opening 6 allows hot air to rise out of the attic space underneath existing roof 1 and flow towards the ambient.

Figure 10:
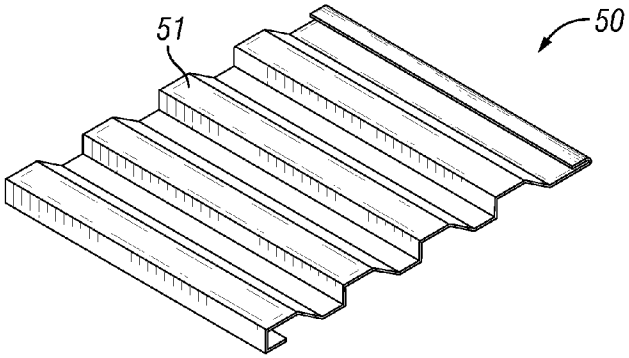
FIG. 10 is a perspective view of a preferred embodiment 50 of panel supports of the subject invention, corrugated panel support 50 being used in novel roof recover 10 shown in FIGS. 1-7.

Panel support 50, which is shown in isolation in FIG. 10, has corrugations 51 running across the body and, when installed, along the pitch of existing roof 1. Although not necessarily apparent from FIG. 10, panel support 50 preferably is somewhat elongated to facilitate installation and typically will be provided in lengths of from about 16 to about 36 inches and in widths of from about 8 to 12 inches which may be overlapped or cut to length as required.

As may be seen best in FIGS. 6 and 7, panel support 50 is installed on existing roof 1 along and proximate ridge R of existing roof 1 and opening 6 therein. Panel support 50 may be mounted on existing roof 1 by fasteners, e.g., screws 59 extending through the lower corrugations 51 in panel support 50, shingles 4, and into deck 3. The upper ends of metal panels 20, when installed, will extend over panel support 50. The height of panel support 50 is coordinated with the height of shelf flanges 33 on panel clips 30 to provide support for panels 20 at more or less the same height. The width of panel support 50 preferably is sufficient to allow it to span butt edges of adjacent rows of shingles 4. It will be appreciated that panel support 50 provides support for metal panels 20 along ridge R while at the same time allowing air flow out of space 11.

Figure 11:
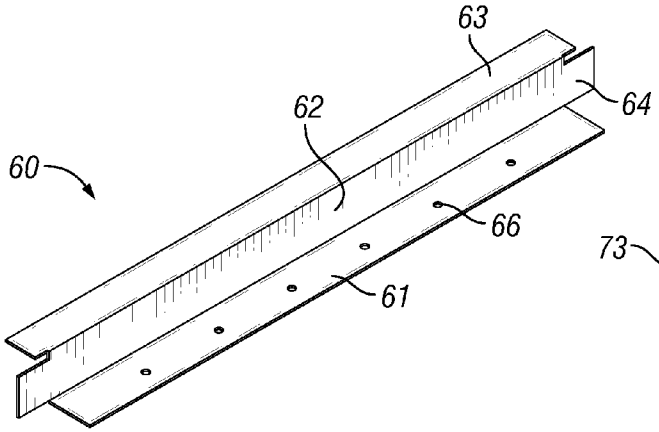
FIG. 11 is a perspective view of at preferred embodiment 60 of trough closures of the subject invention, trough closures 60 being used in novel roof recover 10 shown in FIGS. 1-7.

After metal panels 20 are installed over panel support 50, trough closures 60 are installed. As shown in FIG. 11, trough closures 60 are somewhat elongated, z-shaped components having a horizontal base 62, a vertical extension 63, and a horizontal shelf 64. A pair of tabs 65 extend from the end of vertical extension 63. As best seen in FIG. 6, trough closures 60 are installed in troughs 22 of metal panels 20 proximate to ridge R and above panel support 50. They may be secured thereto by fasteners, such as screws 69 extending through openings 66 in base 61 of trough closure 60, through trough 22 of metal panels 20, and into panel support 50. Metal panels 20 will also thereby be secured to panel support 50. Tabs 64 of trough closures 60 are bent backward (towards ridge R) along seams 21 of metal panels 20. The length of trough closures 60 is such that trough closures 60 will extend substantially across the entire width of trough 22 and, when ridge vent strip 70 is installed as described below, will substantially prevent water from being blown up troughs 22.

Figure 12:
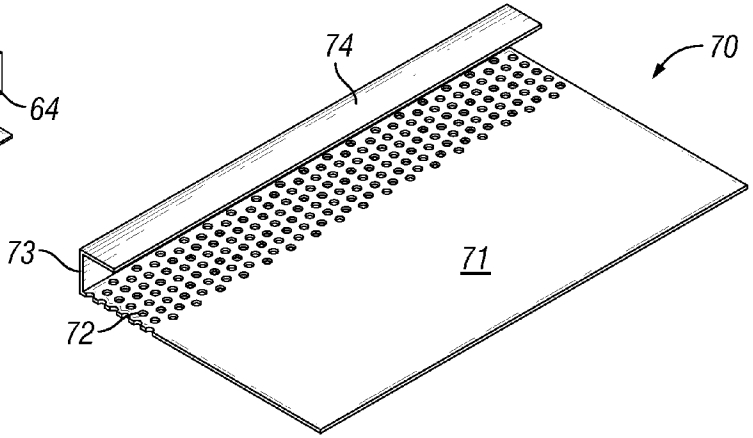
FIG. 12 is a perspective view of a preferred embodiment 70 of ridge vent strips of the subject invention (showing the upper side thereof), ridge vent strip 70 being used in novel roof recover 10 shown in FIGS. 1-7.

Ridge vent strip 70 then is installed on trough closures 60. As may be seen in FIG. 12, ridge vent strip 70 has a generally flat body 71. A vent portion 72 having a plurality of openings runs along one side of body 71. An extension 73 extends vertically from body 71. A shelf 74 extends more or less horizontally from vertical extension 73. Although not necessarily apparent from FIG. 12, ridge vent strip 70 preferably is rather elongated to facilitate installation and typically will be provided in lengths of from about 10 to about 20 feet which may be overlapped or cut to length as required.

As shown in FIGS. 6 and 7, ridge vent strip 70 is installed on shelves 63 of trough closures 60 such that vent portion 72 of ridge vent strip 70 extends beyond (downslope of) trough closures 60. It also will be appreciated that vertical extension 63 of trough closures 60 preferably, as exemplified in FIG. 6, extends somewhat above the top of seams 21 in panels 20. Thus, vent portion 72 of ridge vent strip 70 will also be spaced well above troughs 22 in panels 20. Ridge vent strip 70 may be secured to trough closures 60 by fasteners, such as screws 79 extending through body 71 of ridge vent strip 70 into shelves 63 of trough closures 60.

Ridge cap 80 then may be installed. As appreciated from FIGS. 6-7, ridge cap 80 has a conventional peaked design. The sides of ridge cap 80 are folded down and then out to provide a narrow fascia and a narrow sill. Ridge cap 80 may be installed on ridge vent strips 70 by fasteners, e.g., screws 89 extending through the fascia of ridge cap 80 into vertical extension 73 of ridge vent strip 70. Thus, it will be appreciated that the ridge assembly substantially restricts water from falling, flowing, or being blown into opening 6 running along ridge R or into space 11 between existing roof 1 and recover 10. Importantly, the ridge assembly also allows convective air flow from space 11, through panel support 50, under ridge cap 80, and out through ridge vent strip 70. With that in mind, the configuration of panel support 50 and the size, number, and pattern of openings in vent portion 72 of ridge vent strip 70 may be varied widely. Preferably, such features are coordinated with the other features of the recover such that convective air flow may be established in space 11 allowing air to enter space 11 through eave vent strip 40 and exit through ridge vent strip 70.

The components of the exemplified eave and ridge assemblies preferably are made from steel, such as 16 to 24 gauge galvanized steel sheets that may be easily formed and bent and cut into a desired configuration by conventional metal forming equipment. Such materials provide durable, weather resistant components that may be manufactured easily and economically. Other metals, such as extruded aluminum, may be used to fabricate the components, however, as well as rigid, moldable or extrudable plastics.

It is believed the exemplified eave and ridge assemblies may be used in the novel recover systems to provide effective above sheathing ventilation. The individual components may be fabricated and installed easily and economically, and when installed, effectively minimize the ingress of water into the existing roof or through the recover system. On the other hand, the components of the exemplified assemblies individually or the assemblies as a whole may be varied considerably in accordance with other embodiments of the invention. For example, the corrugations 51 in panel support 50 provide relatively flat upper and lower surfaces. Flat surfaces facilitate installation of the assembly, but corrugations of other shapes may be provided. A plurality of individual spacers, for example, I-shaped spacers may be used instead of a corrugated panel support. Eave and ridge vent strips also may be bent into different configuration, for example, to allow for different installation methods or for other functional reasons and for aesthetic reasons. They also may be assembled from separate components if desired. Various embodiments of the subject invention may incorporate different eave and ridge assemblies including different components.

It also will be appreciated that the novel standing seam roof recovers almost invariably require the use of other components to complete certain portions of a recover installation either for functional purposes, such as weather sealing, or for aesthetic purposes. For example, the roof may incorporate skylights, vent stacks or other projections, and special components may be required for their installation. Similarly, flashing and sealants may be installed in roof valleys, around projections, and elsewhere through the roof. Fascia and soffit components also may be installed along the eaves and gables of the roof. A wide variety of such components and installation methods are known in the art and may be used in the novel roof recovers.

While this invention has been disclosed and discussed primarily in terms of specific embodiments thereof, it is not intended to be limited thereto. Other modifications and embodiments will be apparent to the worker in the art.

What is claimed is:

1. A metal panel standing seam roof recover system installed over an existing shingled roof having a pitch, (a) said existing shingled roof comprising:

i) a support frame including an array of elongated roof support members extending along the pitch of said existing roof;

ii) a deck installed on said roof support members; and iii) a cover installed on said deck, said cover comprising a plurality of shingles installed in overlapping rows running across the pitch of said existing roof, said rows of shingles having a covered upper edge and an exposed lower edge; and (b) said metal panel standing seam roof recover system comprising:

i) a plurality of individual panel clips mounted to said existing roof by a fastener extending through said shingles and into said deck; said panel clips being arranged in linear arrays running along the pitch of said existing roof and having a base that extends across and is supported by the lower edge of a first said row of shingles and the lower edge of an adjacent second said row of shingles, said clip base having a length of from about 6 to about 18 inches;

ii) a recover attached to said panel clips, said recover comprising a plurality of elongated metal panels having upstanding sides defining lateral edges with a trough therebetween, said metal panels being interconnected along adjacent said lateral edges by seams formed on said panel clips;

iii) wherein said panel clips support said metal panels above said cover such that clearance is provided between the top side of said cover and the bottom side of said cover said clearance being sufficient to allow convection airflow through said clearance;

iv) an eave assembly adapted to allow convection air flow into said clearance between said cover and recover; and v) a ridge assembly adapted to allow convection air flow out of said clearance between said cover and said recover.

2. The installed recover system of claim 1, wherein said panel clips are installed by a fastener extending through said shingles proximate to said lower edges thereof and into said deck.

3. The installed recover system of claim 1, wherein said base of said panel clips extends across and is supported by only two said lower edges.

4. The installed recover system of claim 1, wherein said panel clips comprise a vertical body and a horizontal bottom flange, wherein said bottom flange provides said base of said panel clips and wherein said panel clips are installed by a clip fastener extending through said bottom flange, through said shingles proximate to lower edges thereof and into said deck.

5. The installed recover system of claim 1, wherein said metal panels in said roof recover system are symmetrical panels.

6. The installed recover system of claim 1, wherein said eave assembly comprises a vent strip extending along an eave of said recover between the bottom side of said recover and the top side of said cover, said eave vent strip having openings therein adapted to allow convection air flow into said clearance between said cover and recover.

7. The installed recover system of claim 6, wherein said eave vent strip is formed from perforated sheet metal.

8. The installed recover system of claim 6, wherein said eave vent strip has a first portion which is installed on the top side of said cover, a second, intermediate portion in which are provided said openings, and a third portion which is installed on the bottom side of said recover.

9. The installed recover system of claim 1, wherein said ridge assembly comprises:

(a) a vent strip extending along a ridge of said recover, said ridge vent strip having openings and being mounted such that said openings are spaced above said troughs of said metal panels;

(b) a ridge cap mounted on said ridge vent strip, said ridge cap extending over and above said openings in said ridge vent strip whereby convection air flow from said clearance between said cover and recover may flow under said ridge cap and out said openings in said ridge vent strip.

10. The installed recover system of claim 9, wherein said ridge assembly comprises a trough closure extending vertically between said seams of a said metal panel, and wherein said ridge vent strip is mounted on said closure.

11. The installed recover system of claim 9, wherein said ridge assembly comprises a panel support extending along said ridge, said panel support being attached to said cover and having corrugations supporting said metal panels, wherein said corrugations run along the pitch of said roof thereby allowing convection air flow through said panel support.

12. The installed recover system of claim 11, wherein a trough closure is fastened to said corrugated panel support.

13. A method of installing a metal panel standing seam recover over an existing shingled roof having a pitch, wherein:

(a) said existing shingled roof comprises:

i) a support frame which includes an array of elongated roof support members extending along the pitch of said existing roof;

ii) a deck installed on said roof support members; and iii) a cover installed on said deck, said cover comprising a plurality of shingles installed in overlapping rows running across the pitch of said existing roof, said rows of shingles having a covered upper edge and an exposed lower edge;

(b) wherein said method comprises:

i) installing a linear array of individual panel clips on said existing roof with a fastener extending through said shingles and into said deck, said panel clips being installed such that a base of said panel clips extends across and is supported only by the lower, exposed edge of a first said row of shingles and by the lower, exposed edge of an adjacent second said row of shingles; and ii) attaching elongated metal panels to said panel clips by forming seams on said panel clips;

iii) wherein said panel clips support said metal panels above said cover such that clearance is provided between the top side of said cover and the bottom side of said recover and wherein said clearance is sufficient to allow convection air flow through said clearance;

iv) installing an eave assembly adapted to allow convection air flow into said clearance between said cover and recover; and v) installing a ridge assembly adapted to allow convection air flow out of said clearance between said cover and said recover.

14. The method of claim 13, wherein said panel clips comprise a vertical body and a horizontal bottom flange, wherein said bottom flange provides said base of said panel clips and wherein said panel clips are installed by a clip fastener extending through said bottom flange, through said shingles proximate to lower edges thereof and into said deck.

15. The method of claim 13, wherein said ridge assembly comprises a panel support attached to said cover and extending along said ridge, said panel support supporting the ends of said metal panels proximate to said ridge and allowing convection air flow through said panel support and out said ridge assembly.

16. The method of claim 13, wherein said ridge assembly comprises a panel support extending along said ridge, said panel support being attached to said cover and having corrugations supporting said metal panels, wherein said corrugations run along the pitch of said roof thereby allowing convection air flow through said panel support.

17. The method of claim 13, wherein said base of said individual clips has a length of from about 6 to about 18 inches.

18. The method of claim 15, wherein said base of said individual clips has a length of from about 6 to about 18 inches.

19. The installed recover system of claim 1, wherein said ridge assembly comprises a panel support attached to said cover and extending along said ridge, said panel support supporting the ends of said metal panels proximate to said ridge and allowing convection air flow through said panel support and out said ridge assembly.

20. The installed recover system of claim 3, wherein said ridge assembly comprises a panel support attached to said cover and extending along said ridge, said panel support supporting the ends of said metal panels proximate to said ridge and allowing convection air flow through said panel support and out said ridge assembly.

21. The installed recover system of claim 4, wherein said base of said panel clips extends across and is supported by only two said lower edges.

22. The installed recover system of claim 1, wherein said base of said individual clips has a length of about 8 inches.

23. The installed recover system of claim 3, wherein said base of said individual clips has a length of about 8 inches.

24. The method of claim 14, wherein said base of said individual clips has a length of from about 6 to about 18 inches.

25. The method of claim 13, wherein said base of said individual clips has a length of about 8 inches.

26. The method of claim 15, wherein said base of said individual clips has a length of about 8 inches.

* * * * *